US005584599A

United States Patent [19]

Knittel

[11] Patent Number: 5,584,599

[45] Date of Patent: Dec. 17, 1996

[54] MODULAR BARRIER SYSTEM WITH INTERCONNECTED SANDBAGS

[76] Inventor: Richard D. Knittel, Rte. 4, Pinckard Pk., Versailles, Ky. 40383

[21] Appl. No.: 359,154

[22] Filed: Dec. 19, 1994

[51] Int. Cl.[6] ..... E02B 3/10

[52] U.S. Cl. ..... 405/15; 383/32; 383/18; 52/561; 405/21; 405/258; 405/284; 405/107

[58] Field of Search ..... 405/15–21, 29–35, 405/52, 258, 284–286, 107, 111, 114, 115; 150/106, 107, 111, 112, 113; 383/32, 17, 18, 34, 6, 7; 52/561

[56] References Cited

U.S. PATENT DOCUMENTS

| | | | |
|---|---|---|---|
| D. 262,690 | 1/1982 | Berry et al. . | |
| 2,047,095 | 7/1936 | Booth | 383/18 |
| 3,412,502 | 11/1968 | Riches . | |
| 3,665,669 | 5/1972 | Huber . | |
| 3,702,520 | 11/1972 | Huber et al. . | |
| 3,922,832 | 12/1975 | Dicker | 405/18 X |
| 3,957,098 | 5/1976 | Hepworth et al. | 405/19 X |
| 4,297,052 | 10/1981 | Rankin . | |
| 4,362,433 | 12/1982 | Wagner et al. | 405/18 X |
| 4,420,275 | 12/1983 | Rusey | 405/18 X |
| 4,499,599 | 2/1985 | Bolett et al. | 383/32 X |
| 4,650,368 | 3/1987 | Bayer | 405/18 |
| 4,974,709 | 12/1990 | Furlow et al. | 150/111 X |
| 5,257,878 | 11/1993 | Peterson | 405/19 X |

FOREIGN PATENT DOCUMENTS

| | | | |
|---|---|---|---|
| 1201231 | 9/1965 | Germany | 383/32 |

*Primary Examiner*—Dennis L. Taylor
*Attorney, Agent, or Firm*—King and Schickli

[57] ABSTRACT

A modular barrier system and component bags are provided characterized by the component bags being stacked in layers and interconnected to form a retaining wall. Each bag is constructed of a woven tubular sheet that has a rectangular shape when pressed flat. One end of the bag is sealed and the other end is left open to receive sand for filling. Dual elongated straps are bonded to the lower surface of the bag and extend over the side edges. The straps are positioned at ⅕ L, ⅖ L, ⅕ L spacing to be vertically aligned for easy interconnection when the bags are stacked to form the wall. The ends of each strap are folded back to form a loop that receives the strap/loop from a bag in the layer immediately above. The loops also function as handles that allow the bags to be easily lifted and carried.

10 Claims, 2 Drawing Sheets

10
12
20
20'
22
24
P
5

MODULAR BARRIER SYSTEM WITH INTERCONNECTED SANDBAGS

TECHNICAL FIELD

The present invention relates generally to a barrier system; and more particularly, to an improved modular barrier system being constructed from layers of interconnected sandbags.

BACKGROUND OF INVENTION

The need for a modular barrier system or retaining wall arises in many different situations and under various conditions. Common applications for such barrier systems include flood control situations, impact barriers for dangerous points on roads or highways and fortification barriers for military purposes. In many of these situations, time is of the essence and the barrier must be constructed of portable, modular components so that the barrier can be completed as quickly as possible. With flooding in particular, a retaining wall or barrier must be erected quickly in advance of rapidly rising flood waters. In these situations, the portability of the retaining wall components and the ease and speed with which the wall can be constructed are very critical features of the barrier system.

The most common type of modular barrier system known in the prior art uses standard sandbags for its component building blocks. The common sandbag includes a simple bag structure that is most often made from burlap or other similar fabric. The bag is filled through its open end with a fine aggregate material such as sand, and is closed by tying, or otherwise binding, a short length of excess fabric at this open end.

Although this basic sandbag design has proved useful for general applications, it has several shortcomings that reduce its effectiveness in many applications. For example, when common sandbags are stacked to form a retaining wall, only gravity, and to some extent the support of adjacent bags in the longitudinal direction of the wall, keeps the bags in position. In other words, the modular component bags have no positive retaining means to provide support to the wall. It follows that the common sandbag retaining wall often requires substantial depth to provide the necessary structural strength.

Another drawback of the common sandbag is that it is very difficult to lift and carry. To move one of these bags, one must stoop down and reach under the bag to lift it by its body. As these bags can weigh 100 pounds and even more when wet, and are also slippery when wet, this difficult method of picking up and carrying the bags often results in back injuries. Furthermore, these conditions prevent weaker persons from helping to move the bags at all. It is also very difficult for two small or weaker people to carry a single bag, as they must also lift the bag without a way to obtain a secure grasp of the bag. It follows that these limitations can seriously hinder efforts to quickly build a retaining wall.

In an attempt to design around the inherent instability of common sandbag walls, several designs of interlocking, semi-solid construction blocks have been made. Typical of these designs are the U.S. Pat. Nos. 3,665,669 and 3,702,520 to Huber. These patents disclose building blocks that are folded from a flat sheet of material to form a container that is filled with sand. The blocks include tabs that extend from one face and mating slots in an opposing face for receiving the tabs from an adjacent block.

Although these tabs provide a positive connection means for adjacent blocks in the wall, they also suffer from several limitations. First, the tabs are easily bent or torn off and the blocks must be handled carefully to avoid such damage. Also, building a wall with these blocks requires precisely aligning each tab with the mating slots of the adjacent block. These constraints make these blocks ill-suited for situations in which a retaining wall must be built as quickly as possible. Further, the flat sheet faces of these blocks do not provide a stable base when used on uneven ground, which is common in many retaining wall applications. Finally, the relative high cost of the containers, especially given the limited size which increases the number required per unit wall length, is a decidedly limiting factor in use.

Thus, as demonstrated by the deficiencies of the prior art, there is a need identified for a modular barrier system that provides enhanced structural integrity and stability through interconnected components, and utilizes individual bags that are highly portable and can be combined quickly and easily to form a retaining wall.

SUMMARY OF INVENTION

Accordingly, it is a primary object of the present invention to provide an improved barrier system having components and features that are designed to overcome the limitations of the prior art.

Another object of the present invention is to provide a modular barrier system having a plurality of component bags that are stacked in layers to form a retaining wall and are interconnected to provide improved structural integrity.

It is still another object of the present invention to provide component bags, and a wall constructed of such bags, which have dual straps with loops at each end for engaging with the straps of adjacent bags to provide positive reinforcement for the retaining wall.

It is another object of the present invention to provide component bags that may be quickly and efficiently joined together to form the retaining wall.

It is yet another object of the present invention to provide component bags having straps with loops at each end that also function as handles for easy carrying and improved portability.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

BRIEF DESCRIPTION OF THE INVENTION

To achieve the foregoing and other objects, an improved barrier system is provided including modular component bags that are interconnected for enhanced structural integrity and that are easily lifted and carried. The barrier system is particularly suited for flood control situations and other applications where a retaining wall must be quickly constructed. In the preferred embodiment, each bag is fabricated from a woven tubular sheet made of flexible material, such as nylon. The sheet is pressed flat into a rectangular shape having a length to width ratio of approximately five-to-three. One end of the sheet is stitched closed while the other end remains open to receive a fine aggregate packing material, such as sand. When filled with sand the bag takes on a pillow-like shape.

Dual elongated straps are affixed to the lower surface of the sheet and extend laterally across the width of the sheet and over both sides. With the length of the sheet being L, one strap is preferably spaced ⅕ L from the closed end and the second strap is spaced ⅖ L from the open end; the other ⅖ L being in between the straps. The additional space between the second strap and the open end allows the bag to be bound after it is filled. This spacing of the straps also permits the bags to be stacked in layers such that the straps in adjacent layers are vertically aligned to allow for easy interconnection.

In a further aspect of the present invention, both ends of each strap are folded back and secured to form a loop. By interconnecting the loops/straps of the bags in adjacent layers, the retaining wall is given integral reinforcement and improved stability. This reinforced barrier system requires fewer bags to provide the same strength as the common sandbag wall having no integral reinforcement. Additionally, the retaining wall of the present invention is easily and quickly constructed and does not require delicate or precise alignment.

In another important aspect of the present invention, the loops at the ends of each strap also function as handles that allow the component bags to be easily lifted and carried. With these handles a bag can be carried by two or more persons who independently would be unable to lift the bag. Additionally, the flexible or malleable nature of the bags makes them particularly well suited for use on uneven ground, and the vertically aligned straps give the barrier system a neat and generally aesthetically pleasing appearance.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

FIG. 4 is a side view of the retaining wall showing the component bags stacked in layers with the straps/loops of a bag in a lower layer being interconnected with the straps/loops of a bag in the layer immediately above.

DETAILED DESCRIPTION OF THE DRAWINGS

Figures 1, 2, 5:
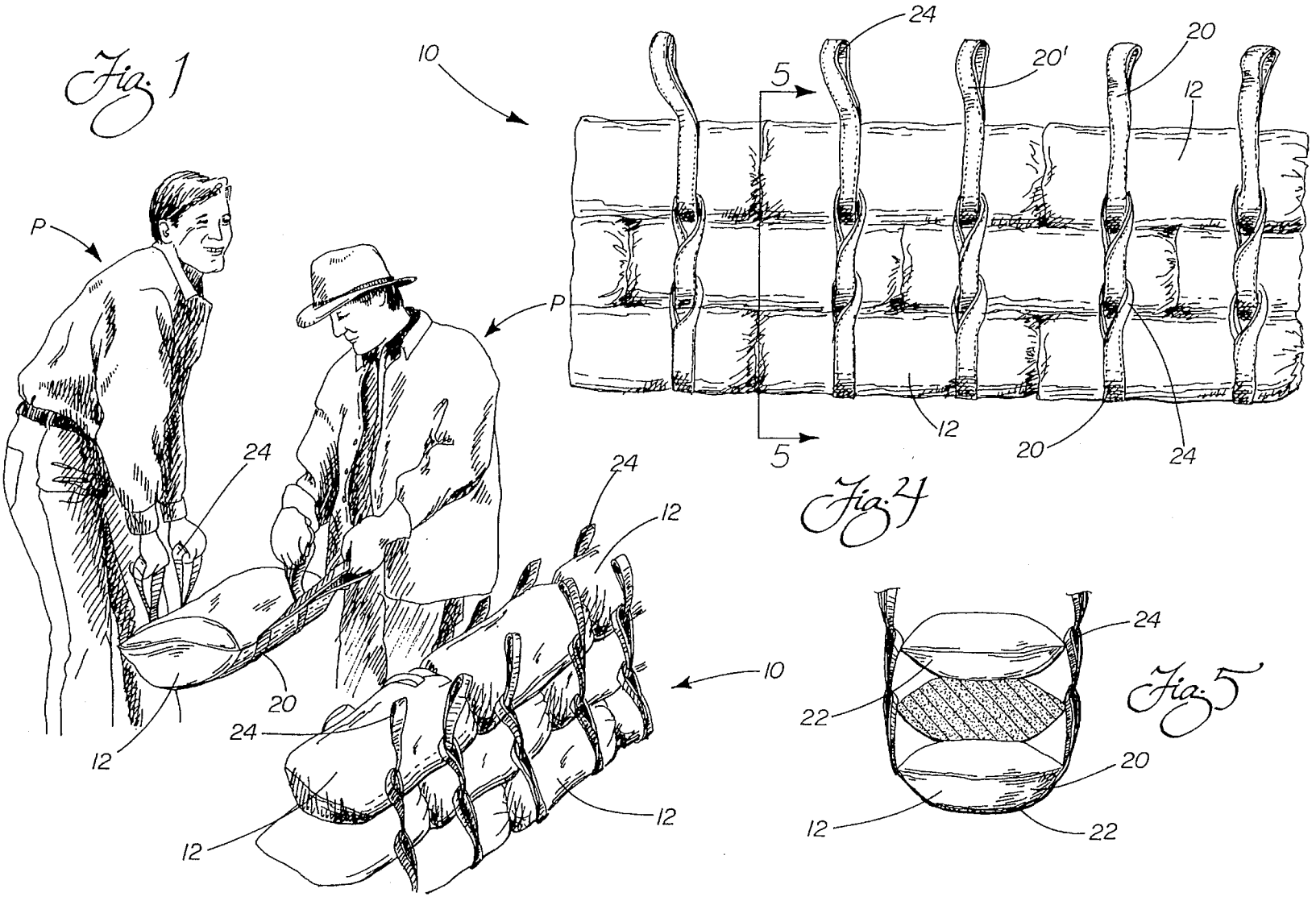
FIG. 1 is a perspective view of the barrier system of the present invention showing the component bags being stacked in layers and interconnected to form a retaining wall, and showing a bag being lifted by the carrying/connecting straps.
FIG. 2 is a perspective view of a component bag filled with sand and resting on its side with one carrying/connecting loop extending upward.
FIG. 5 is a cross section view of the retaining wall taken along line 5—5 showing the straps of one bag feeding through the loops of the bag immediately below on both sides of the wall, and showing the sand filler in one of the bags.

Reference is now made to FIG. 1 of the drawings showing the preferred embodiment of a modular barrier system with interconnected sandbags according to the present invention, and generally represented by the reference numeral 10. The barrier system 10 is particularly suited for flood control situations and other applications in which a retaining wall must be constructed as quickly as possible.

Figure 3:
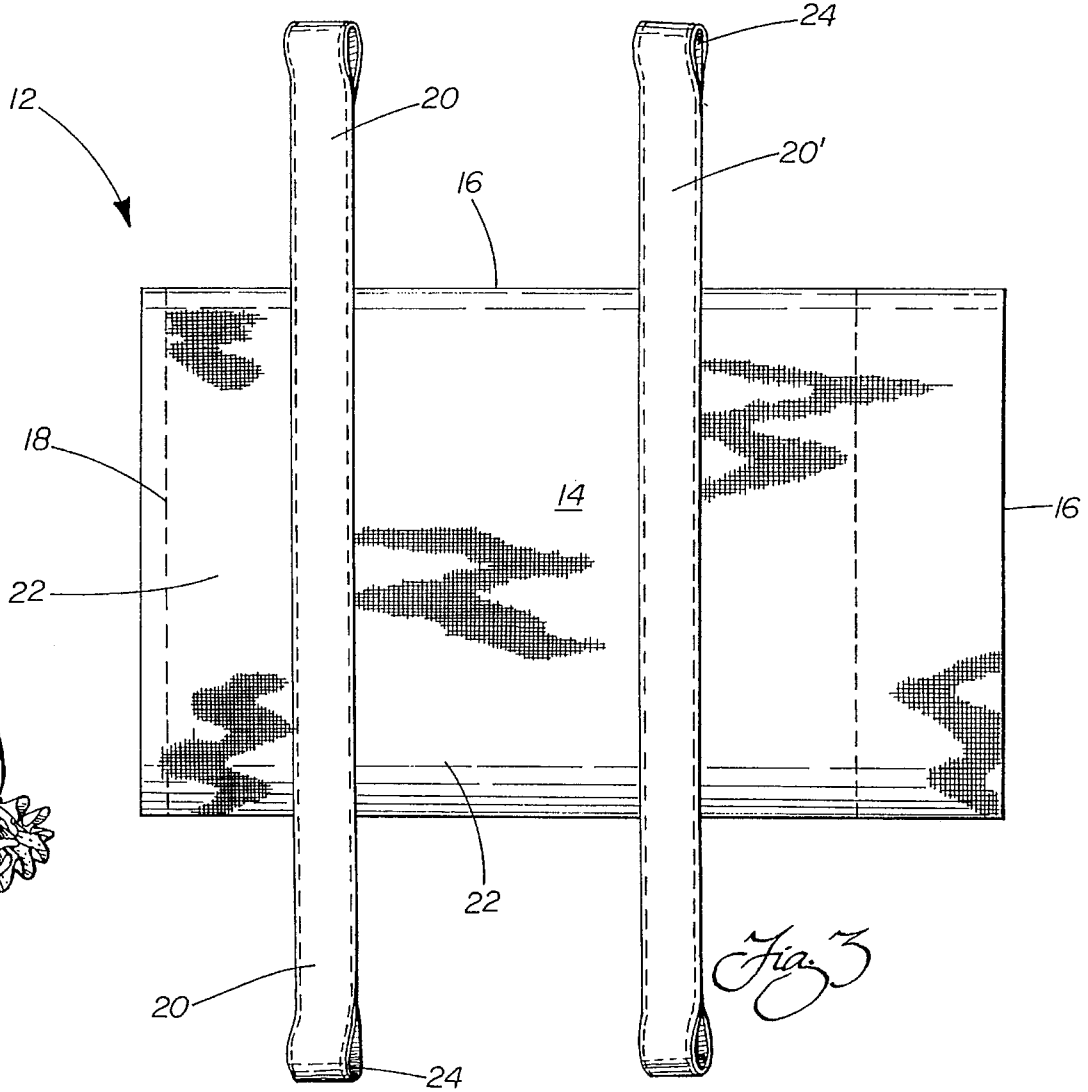
FIG. 3 is a bottom view of an empty bag showing the carrying/connecting straps with side loops extending from both sides of the bag.
Figure 2:
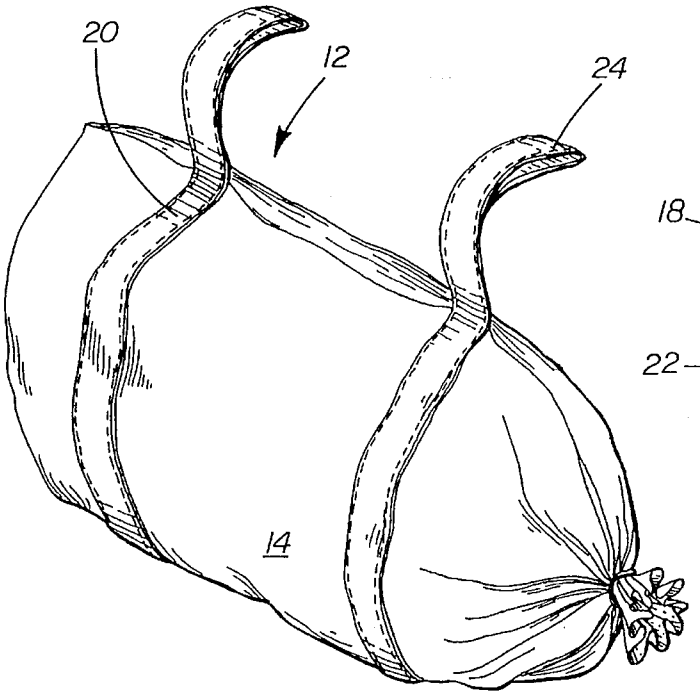

The barrier system 10 is comprised of a plurality of interconnected component or modular bags 12 that are filled with a fine aggregate packing material, such as sand, or other granular material. As illustrated in FIGS. 2 and 3, each bag 12 is constructed of a tubular sheet 14 that is woven from a durable and flexible material, such as nylon strands. The sheet 14 is originally flat in a rectangular shape for initial storage and handling. It has a preferred length to width ratio of approximately five to three. For example, in one version, the typical bag has a length of 30 inches and a width of 18 inches. The flat bag may even form creases 16 around the periphery of the bag 12 that allows the bag to more easily maintain a rectangular shape when empty for convenient storage/handling.

One end of the bag 12 is folded over and sealed closed by stitching 18 that runs across the width of the tubular sheet 14. The other end of the bag 12 is left open to allow the bag to be filled with sand or other packing material. As shown in FIG. 5, this construction gives the bags 12 a pillow-like shape when filled.

With reference now to FIG. 3, first and second elongated straps 20, 20' extend laterally across the lower surface 22 of the sheet 14. Preferably, each strap 20, 20' is affixed to the lower surface 22 by an adhesive, stitching or other suitable bonding method (not shown). With the preferred length of the sheet 14 being L, the first strap 20 is preferably positioned approximately ⅕ L from the closed end of the bag 12. The second strap 20' is preferably positioned approximately ⅖ L from the open end of the bag; the remaining ⅖ L being in between the straps. As discussed in more detail below, this particular spacing of the straps 20, 20' allows for fast and efficient construction of the barrier system 10. Additionally, the space provided between the second strap 20' and the open end of the bag 12 insures that approximately ⅕ L of bag material remains that can be bunched together and bound after the bag is filled.

In a further aspect of the present invention, both ends of each strap 20, 20' extending from the sides of the bag 12 are folded back and affixed to themselves to form a loop 24. As best seen in FIGS. 1 and 4, the loops 24 allow the bags in adjacent layers of the barrier system 10 to be interconnected by threading the straps 20, 20'/loops 24 of one bag through the loops 24 of a lower bag. Advantageously, this interconnection of the component bags 12 yields positive reinforcement and improved stability as compared to retaining walls made of passively stacked sandbags that have only gravity to keep them in place. It follows that the barrier system 10 requires fewer component bags 12 to provide the same strength and structural integrity as an ordinary, passive sandbag wall with no integral reinforcement.

In another important aspect of the present invention, the loops 24 at the end of each strap 20, 20' also function as handles that allow the bags 12 to be easily lifted and carried. Typical sandbags can weigh over 100 pounds and may be carried only by bending over and reaching under the bag to lift it by its body. This difficult method of stooping and lifting to carry the common sandbag often leads to back injuries and means that smaller and weaker persons cannot carry these bags to the desired location. In rural flooding situations where a family may have little outside help, this limitation often keeps the weaker members of the family from helping to move these sandbags.

Advantageously, the loops 24 extend above the top of the component bags 12 on each side and allow the bags to be conveniently lifted and carried without excessive stooping and bending. Additionally, as shown in FIG. 1, the loops 24 allow a bag 12 to be easily carried by two people P. Thus, children and smaller adults can help move the bags 12 and contribute to actually building the retaining wall. Further, multiple or piggy back bags can be stacked and carried by two stronger individuals. It follows that the convenient carrying means provided by the loops 24 increases the speed with which the barrier system 10 can be constructed.

The particular spacing of the straps 20, 20' on each bag 12 also allows the barrier system 10 to be quickly built without precise and time-consuming alignment. As illustrated in FIG. 4, the barrier system 10 is constructed by placing the bags 12 end to end in layers such that each bag rests on the front half and back half of adjacent bags in the layer immediately below. In this easy-to-build configuration, the straps 20, 20' of the bags 12 in adjacent layers are vertically aligned to allow for convenient interconnection. Furthermore, the flexibility of the nylon straps 20, 20' allows for a generous margin for error in stacking the bags, such that precise alignment is not required for interconnection. If a slight mismatch is made on one layer, it can be quickly and easily corrected on the next layer up. This feature is of critical importance in time-pressured situations, such as flooding, where a retaining wall must be constructed as quickly as possible.

In a further aspect of the present invention, the flexible and malleable (when filled) nature of the component bags 12 makes them particularly well-suited for use on uneven ground or curving surfaces. Unlike the rigid construction blocks with a flat lower surface of the prior art, the bags 12 readily conform to rough or bumpy surfaces to insure a solid foundation for the barrier system 10. Additionally, as illustrated by FIG. 4, the vertically aligned straps 20, 20' give the barrier system 10 a neat and generally aesthetically pleasing appearance that is particularly desirable for some uses, such as impact barriers On public roads and highways.

In summary, the modular barrier system 10 exhibits features and advantages not heretofore available in the typical sandbag retaining walls and flat construction blocks of the prior art. The dual elongated straps 20, 20' and loops 24 allow the component bags 12 to be interconnected to form a retaining wall with integral reinforcement and improved strength and stability. The spacing of the straps 20, 20' allows the bags 12 to be stacked in layers without precise alignment for easy and quick construction. Additionally, the loops 24 at the ends of each strap 20, 20' function as handles that allow the bags to be easily lifted and carried to further decrease construction time.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

I claim:

1. A barrier system particularly suited for retaining water or absorbing impact forces, comprising:

a plurality of bags, dual carrying and connecting means including at least two straps affixed at spaced locations on each of said bags, each of said straps extending from said bag to form a loop for grasping and engaging a corresponding strap of an adjacent bag to interconnect said bags, and aggregate material filling each of said bags, whereby said straps/loops allow for easy carrying and interconnection of said bags, said interconnected bags forming a wall having enhanced structural integrity and stability.

2. The barrier system as set forth in claim 1, wherein each of said bags includes:

a tubular sheet of flexible material having a generally rectangular shape and having a sealed end and an open end.

3. The barrier system as set forth in claim 1, wherein said carrying and connecting means comprises first and second continuous, elongated straps extending laterally across the lower surface of said sheet and upwardly along each side of each of said bags.

4. The barrier system as set forth in claim 3, wherein said bags are arranged end-to-end in layers to form said wall, whereby said straps of said bags are substantially vertically aligned and are interconnected to provide positive reinforcement to said wall.

5. The barrier system as set forth in claim 3, wherein said straps have each end folded back over and affixed to themselves to form a loop, whereby said straps/loops allow for easy lifting and carrying of said bags.

6. The barrier system as set forth in claim 5, wherein said straps of said bags in an upper layer thread through said loops of said bags in a lower layer to interconnect said bags.

7. The barrier system as set forth in claim 3, Wherein each of said bags has a length L and the distance between said sealed end and said first strap is approximately ⅕ L and the distance between said open end and said second strap is approximately ⅖ L.

8. The barrier system as set forth in claim 7, wherein the ratio of said length L to the width of each of said bags is approximately 5 to 3.

9. The barrier system as set forth in claim 7, Wherein each of said bags is sealed along a line located approximately ⅕ L from said open end after being filled with said fine aggregate material.

10. The barrier system as set forth in claim 1, wherein said aggregate material is sand.

* * * * *